US007938676B1

(12) United States Patent
Patel et al.

(10) Patent No.: US 7,938,676 B1
(45) Date of Patent: May 10, 2011

(54) RECEPTACLE WITH ANTENNA

(75) Inventors: Parimal R. Patel, Brookhaven, NY (US); Danilo F. Estanislao, Old Bridge, NJ (US)

(73) Assignee: Leviton Mfg. Co., Melville, NY (US)

( * ) Notice: Subject to any disclaimer, the term of this patent is extended or adjusted under 35 U.S.C. 154(b) by 0 days.

(21) Appl. No.: 12/610,240

(22) Filed: Oct. 30, 2009

(51) Int. Cl.
*H01R 3/00* (2006.01)

(52) U.S. Cl. ..... 439/489; 439/137; 439/916

(58) Field of Classification Search ..... 439/135–137, 439/488–490, 916
See application file for complete search history.

(56) References Cited

U.S. PATENT DOCUMENTS

| | | | |
|---|---|---|---|
| 2,540,496 | A | 2/1951 | Sperazza |
| 2,826,652 | A | 3/1958 | Piplack |
| 2,926,327 | A | 2/1960 | Metelli |
| 3,222,631 | A | 12/1965 | Cohen |
| 3,238,492 | A | 3/1966 | Houston |
| 3,617,662 | A | 11/1971 | Miller |
| 3,775,726 | A | 11/1973 | Gress |
| 3,986,763 | A | 10/1976 | Sparrow |
| 3,990,758 | A | 11/1976 | Petterson |
| 4,072,382 | A | 2/1978 | Reschke |
| 4,148,536 | A | 4/1979 | Petropoulsos et al. |
| 4,168,104 | A | 9/1979 | Bushow |
| 4,271,337 | A | 6/1981 | Barkas |
| 4,379,607 | A | 4/1983 | Bowden, Jr. |
| 4,386,338 | A | 5/1983 | Doyle et al. |
| D269,341 | S | 6/1983 | Doyle et al. |
| D269,342 | S | 6/1983 | Doyle et al. |
| D269,427 | S | 6/1983 | Doyle et al. |
| D269,428 | S | 6/1983 | Doyle et al. |
| D269,429 | S | 6/1983 | Doyle et al. |
| D269,430 | S | 6/1983 | Doyle et al. |
| D269,431 | S | 6/1983 | Doyle et al. |
| D269,509 | S | 6/1983 | Doyle et al. |
| D269,510 | S | 6/1983 | Doyle et al. |
| D269,969 | S | 8/1983 | Doyle et al. |
| D271,869 | S | 12/1983 | Doyle et al. |
| 4,518,945 | A | 5/1985 | Doyle et al. |
| 4,544,219 | A | 10/1985 | Barkas |
| 4,603,932 | A | 8/1986 | Heverly |
| 4,714,858 | A | 12/1987 | Sanders |

(Continued)

FOREIGN PATENT DOCUMENTS

| | | |
|---|---|---|
| CA | 2239573 | 12/1998 |

(Continued)

OTHER PUBLICATIONS

Airwave Specification Overview, Airwave, Wireless by Ledalite, Mar. 4, 2009, 2 pgs.

(Continued)

*Primary Examiner* — Khiem Nguyen
(74) *Attorney, Agent, or Firm* — Foley & Lardner LLP

(57) ABSTRACT

An electrical receptacle is disclosed. The electrical receptacle includes a housing and at least one socket at least partially disposed within the housing and having at least a pair of entry ports. The at least one socket is controllable by a radio frequency signal. The electrical receptacle also includes an antenna at least partially disposed within the housing configured to at least receive the radio frequency signal used to control the at least one socket. The electrical receptacle further includes at least one tamper resistant device at least partially disposed within the housing. The at least one tamper resistant device is configured to block the entry ports unless a mating electrical plug is inserted into the at least one socket.

15 Claims, 11 Drawing Sheets

U.S. PATENT DOCUMENTS

| | | | |
|---|---|---|---|
| 4,722,693 | A | 2/1988 | Rose |
| 4,867,693 | A | 9/1989 | Gizienski et al. |
| 4,867,694 | A | 9/1989 | Short |
| 4,897,049 | A | 1/1990 | Miller et al. |
| 4,909,749 | A | 3/1990 | Long |
| 4,936,789 | A | 6/1990 | Ugalde |
| 5,006,075 | A | 4/1991 | Bowden, Jr. |
| 5,020,997 | A | 6/1991 | Calderara et al. |
| 5,069,630 | A | 12/1991 | Tseng et al. |
| 5,157,273 | A | 10/1992 | Medendorp et al. |
| 5,277,607 | A | 1/1994 | Thumma et al. |
| 5,320,545 | A | 6/1994 | Brothers |
| 5,374,199 | A | 12/1994 | Chung |
| 5,391,085 | A | 2/1995 | Tigner |
| 5,455,487 | A | 10/1995 | Mix et al. |
| 5,518,132 | A | 5/1996 | Chen |
| 5,551,884 | A | 9/1996 | Burkhart, Sr. |
| 5,598,042 | A | 1/1997 | Mix et al. |
| 5,702,259 | A | 12/1997 | Lee |
| 5,748,466 | A | 5/1998 | McGivern et al. |
| 5,839,909 | A | 11/1998 | Calderara et al. |
| D402,186 | S | 12/1998 | Pearse |
| 5,846,092 | A | 12/1998 | Feldman et al. |
| 5,898,407 | A | 4/1999 | Paulus et al. |
| 5,902,140 | A | 5/1999 | Cheung et al. |
| 5,905,442 | A | 5/1999 | Mosebrook et al. |
| 5,915,981 | A | 6/1999 | Mehta |
| D419,531 | S | 1/2000 | Keung et al. |
| 6,086,391 | A | 7/2000 | Chiu |
| 6,089,893 | A | 7/2000 | Yu et al. |
| 6,111,210 | A | 8/2000 | Allison |
| D430,539 | S | 9/2000 | Leopold et al. |
| 6,149,446 | A | 11/2000 | Yu |
| 6,217,353 | B1 | 4/2001 | Yu-Tse |
| 6,224,401 | B1 | 5/2001 | Yu |
| 6,238,224 | B1 | 5/2001 | Shao |
| 6,299,487 | B1 | 10/2001 | Lopata et al. |
| 6,418,324 | B1 | 7/2002 | Doviak et al. |
| 6,422,880 | B1 | 7/2002 | Chiu |
| 6,537,088 | B2 | 3/2003 | Huang |
| 6,537,089 | B1 | 3/2003 | Montague |
| 6,703,786 | B2 | 3/2004 | Tannenbaum |
| 6,734,769 | B1 | 5/2004 | Germain et al. |
| 6,749,449 | B2 | 6/2004 | Mortun et al. |
| 6,756,998 | B1 | 6/2004 | Bilger |
| 6,767,228 | B2 | 7/2004 | Katz |
| 6,776,630 | B1 | 8/2004 | Huang |
| 6,786,745 | B1 | 9/2004 | Huang |
| 6,827,602 | B2 | 12/2004 | Greene et al. |
| 6,873,231 | B2 | 3/2005 | Germain et al. |
| 6,893,275 | B2 | 5/2005 | Ng et al. |
| 6,896,530 | B2 | 5/2005 | Nishio et al. |
| 6,909,921 | B1 | 6/2005 | Bilger |
| 6,932,631 | B2 | 8/2005 | Huang |
| 6,940,230 | B2 | 9/2005 | Myron et al. |
| 6,949,994 | B2 | 9/2005 | Germain et al. |
| 6,963,260 | B2 | 11/2005 | Germain et al. |
| 6,969,801 | B2 | 11/2005 | Radosavljevic et al. |
| 6,979,212 | B1 | 12/2005 | Gorman |
| 6,986,674 | B1 | 1/2006 | Gorman |
| 6,993,417 | B2 | 1/2006 | Osann, Jr. |
| 7,026,895 | B2 | 4/2006 | Germain et al. |
| 7,027,416 | B1 | 4/2006 | Kriz |
| D521,932 | S | 5/2006 | Fort et al. |
| 7,088,205 | B2 | 8/2006 | Germain et al. |
| 7,088,206 | B2 | 8/2006 | Germain et al. |
| 7,114,968 | B2 | 10/2006 | Healy |
| 7,123,139 | B2 | 10/2006 | Sweeney |
| 7,129,413 | B1 | 10/2006 | Rao et al. |
| D535,254 | S | 1/2007 | Bazayev et al. |
| D535,255 | S | 1/2007 | Bazayev et al. |
| 7,179,992 | B1 | 2/2007 | Packard et al. |
| D545,272 | S | 6/2007 | Zhang et al. |
| 7,227,435 | B2 | 6/2007 | Germain et al. |
| 7,230,532 | B2 | 6/2007 | Albsmeier et al. |
| 7,312,394 | B1 | 12/2007 | Weeks et al. |
| 7,312,963 | B1 | 12/2007 | Radosavljevic et al. |
| D558,676 | S | 1/2008 | Fort et al. |
| 7,355,117 | B2 | 4/2008 | Castaldo et al. |
| 7,415,310 | B2 | 8/2008 | Bovee et al. |
| 7,439,833 | B2 | 10/2008 | Germain et al. |
| 7,455,538 | B2 | 11/2008 | Germain |
| 7,551,047 | B2 | 6/2009 | Sokolow et al. |
| D601,962 | S | 10/2009 | Song |
| 2002/0097546 | A1 | 7/2002 | Weinberger |
| 2004/0203270 | A1 | 10/2004 | Wang |
| 2005/0030177 | A1 | 2/2005 | Albsmeier et al. |
| 2006/0181373 | A1 | 8/2006 | Germain et al. |
| 2007/0049077 | A1 | 3/2007 | Germain |
| 2007/0049079 | A1 | 3/2007 | Nalwad et al. |
| 2007/0075852 | A1 | 4/2007 | Schmidt et al. |
| 2007/0111569 | A1 | 5/2007 | Germain et al. |
| 2008/0094210 | A1 | 4/2008 | Paradiso et al. |
| 2008/0156512 | A1 | 7/2008 | Castaldo et al. |
| 2008/0248662 | A1 | 10/2008 | Bazayev et al. |
| 2008/0303661 | A1 | 12/2008 | Chick |
| 2009/0286411 | A1 | 11/2009 | Bazayev et al. |

FOREIGN PATENT DOCUMENTS

| | | |
|---|---|---|
| GB | 2396489 | 6/2004 |
| WO | WO 00/17728 | 3/2000 |

OTHER PUBLICATIONS

Bach, Ambient light powered Occupancy Sensor for Indoor, Application Note, EnOcean, Dec. 2006, Germany 3 pgs.

Bach, Demo of Self-Powered PIR Radio Sensor, Application Note AN013, EnOcean, Jan. 2007, 8 pgs.

Bach, Motion Sensor—Design Example for an Ambient Light Powered PIR, Application Note 306, EnOcean, Jan. 21, 2009 (earliest suspected availability date extracted from digital document) 7 pgs.

Bach, Power Supply Layout—Layout considerations for Line-Power Supplies, Application Note 101, EnOcean, Jan. 20, 2009, 4pgs.

Bach, Self-Powered PIR Radio Sensor starting at 40 lx, Application Note AN013A, EnOcean, Aug. 2007, Germany, 4 pgs.

BlueGuard™—Bluetooth® Enabled Stand-Alone Access Control, EMX Industries, Inc., May 6, 2009, 2 pgs.

Concept of a Occupancy Sensor Light Switch, Application Note AN012, EnOcean, Sep. 2007, Germany, 2 pgs.

Email: Webview: BlueGuard™, EMX Industries, Inc., Retrieved from https://app.e2ma.net/app/view:CampaignPublic/id:11837.2660427172/rid:8eab837bc3cbf22e79d... Retrieved on Dec. 15, 2009, 1 pg.

Energy Conservation—Home and Office, echoflex, EnOcean Alliance, Oct. 20, 2008 (earliest suspected availability date extracted from digital document), Squamish, B.C., Canada, 41 pgs.

Frequently Asked Questions, Airwave, Ledalite, Mar. 1, 2009, 6 pgs.

Heath®/Zenith : Wireless Outdoor Power Control—Model 6022: Features and Operation, 2007, 20 pgs.

Klipsch®—Light Speaker: Owner's Manual and Installation Instructions, Nov. 22, 2009, Indianapolis, 48 pgs.

*Lutron*®—"New Occupancy/Vacancy Sensor Sets a Higher Performance Standard", [News Release] , Jun. 9, 2009, Coopersburg, Retrieved from http://www.lutron.com/news/press_release.aspx?cid=0&ArticleId=420, Retrieved on Jul. 2, 2009, 2 pgs.

Lutron®—Overview of Lutron requirements for RF Communications, Aug. 2006, 15 pgs.

OPUS-FUNK plus, Jager Direkt GmbH & Co., Jul. 2, 2006, Germany, 2 pgs.

Technical Guide, Airwave, Ledalite, Mar. 5, 2009, 14 pgs.

Wireless Ceiling Multi Sensor 360°, SR-MDS, thermokon Sensortechnik GmbH, Dec. 2007, Germany, 7 pgs.

U.S. Non-Final Office Action mailed Jan. 14, 2011 in U.S. Appl. No. 29/346,468.

RECEPTACLE WITH ANTENNA

BACKGROUND

The present disclosure relates to an electrical receptacle having an antenna configured to at least receive radio frequency (RF) signals for controlling (e.g., powering on/off, etc.) an electrical outlet or socket of the electrical receptacle, and an antenna therefor.

Electrical receptacles may include an antenna that allows for the wireless control of at least one electrical socket of the electrical receptacle. Such antennas are typically provided in the form of a wire. However, electrical receptacles with such antennas do not provide protective features to prevent foreign objects from being inserted into the openings of the receptacle. Such receptacles do not protect against insertion of objects such as paper clips, screwdriver blades, etc. into the receptacle contact openings. Also, it has been found that wire antennas used within electrical receptacles may be susceptible to becoming de-tuned when a cord (e.g., an extension cable, etc.) having considerable length is plugged into the electrical socket.

SUMMARY

One embodiment of the invention relates to an electrical receptacle including a housing and at least one socket at least partially disposed within the housing and having at least a pair of entry ports. The at least one socket is controllable by a radio frequency signal. The electrical receptacle also includes an antenna at least partially disposed within the housing configured to at least receive the radio frequency signal used to control the at least one socket. The electrical receptacle further includes at least one tamper resistant device at least partially disposed within the housing. The at least one tamper resistant device is configured to block the entry ports unless a mating electrical plug is inserted into the at least one socket.

Another embodiment of the invention relates to an electrical receptacle including a housing, at least one electrical socket being controllable by a radio frequency signal, at least one printed circuit board at least partially disposed within the housing and a circuit at least partially supported by the printed circuit board. The circuit is configured to control the at least one electrical socket. The electrical receptacle also includes an antenna supported within the housing configured to at least receive the radio frequency signal used to control the at least one electrical socket. The antenna is formed of a sheet material and has a first end and a second end. The first end of the antenna is coupled to the circuit.

Another embodiment of the invention relates to an antenna for an electrical receptacle. The antenna includes a body formed of a substantially flexible sheet material. The body has a first end and a second end. The first end of the antenna is configured to be coupled to a circuit that is configured to be at least partially supported by a printed circuit board at least partially disposed within the electrical receptacle.

DETAILED DESCRIPTION

Referring generally to the FIGURES, an electrical receptacle 10 and components thereof are shown according to an exemplary embodiment. Electrical receptacle 10 may be installed within or mounted to a wall, a ceiling, a floor and/or any other area or surface where it would be desirable to provide a connection point to a power source. According to the various alternative embodiments, electrical receptacle 10 can include one or more electrical sockets each configured as a two-prong electrical receptacle and/or may be configured as a receptacle other than that of a duplex receptacle (e.g., a single receptacle, a triplex receptacle, etc.). Alternatively, electrical receptacle 10 may include one or more outlets of any suitable configuration. For example, such configurations may include, but not be limited to, NEMA 1-15, 2-15, 5-15, 5-20, 6-15, 6-20, 7-15 or 7-20 configurations.

Electrical receptacle 10 is illustrated as a duplex-type receptacle having a first or upper electrical socket 12 and a second or lower electrical socket 14. Each of electrical sockets 12, 14 has entry ports for receiving a mating electrical plug. One or more of first electrical socket 12 and second electrical socket 14 are configured to be selectively actuated (e.g., powered on/off, etc.) via a wireless control device (e.g., a mobile control device and/or a stationary control device, etc.). For example, the one or more electrical sockets may be controlled by a device that utilizes radio frequency (RF) signals for controlling whether the electrical socket is on or off. According to the embodiment illustrated, first electrical socket 12 is configured to be actuated via a wireless a control device, while second electrical socket 14 is configured to be wired to a main power source such as 110 volts AC. According to the various alternative embodiments, both first electrical socket 12 and second electrical socket 14 may be configured to be selectively actuated via a wireless control device.

Figure 1:
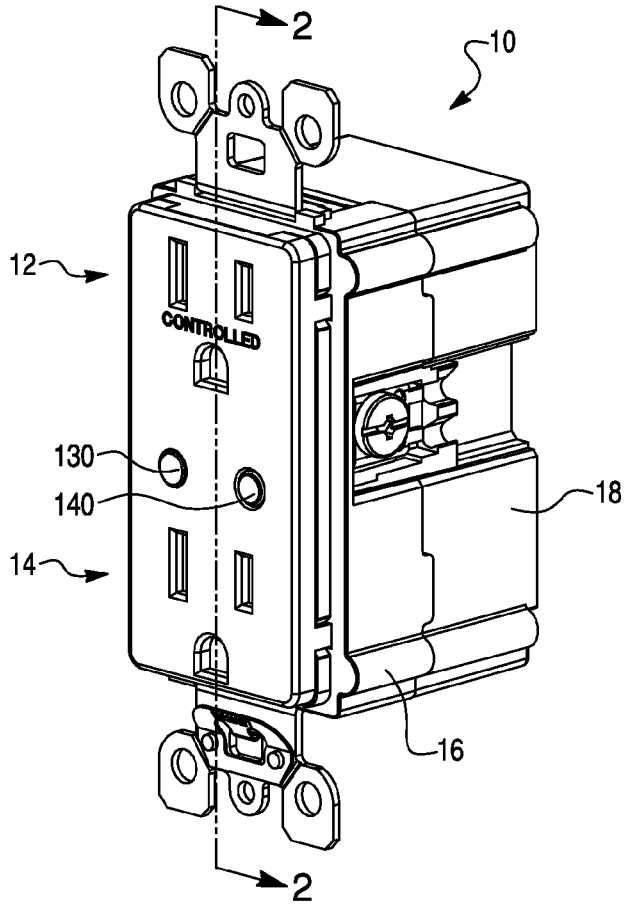
FIG. 1 is a top right perspective view of an electrical receptacle according to an exemplary embodiment.

Referring to FIG. 1, electrical receptacle 10 includes a housing having a first portion (e.g., front, cover, top, etc.), shown as a sub-face or face portion 16, and a second portion (e.g., rear, base, bottom, etc.), shown as a back portion 18. Face portion 16 can be removably coupled to back portion 18 using one or more mechanical fasteners, shown as screws 20 in FIG. 3, which are inserted through connection holes 22 that extend through back portion 18 and partially into face portion 16. Face portion 16 and back portion 18 substantially enclose and protect the components of electrical receptacle 10, including a middle housing (e.g., support structure, etc.), shown as a rack 24 in FIGS. 2 and 3.

Rack 24 provides a base or platform for supporting at least some of the components of electrical receptacle 10. According to an exemplary embodiment, rack 24 is a one-piece molded structure formed of a dielectric material, such as plastic, but alternatively, may be formed of any insulating material and provided in any number of pieces. Components can be supported on both a front and back side of rack 24. To support such components, rack 24 includes a number of projections that define a number of cavities, passageways and/or platforms configured to receive and support the components.

Figure 23:
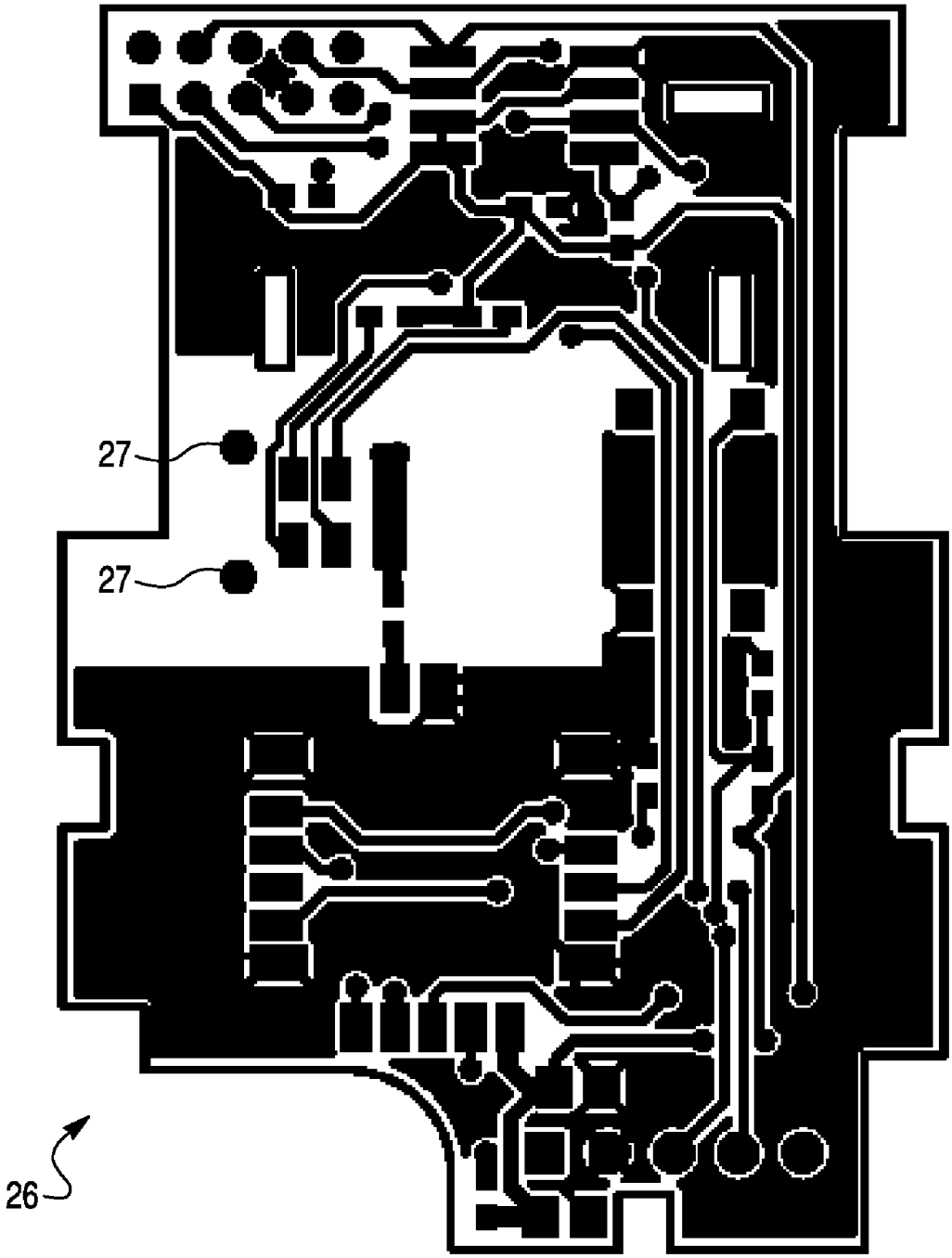
FIG. 23 is a front view of a printed circuit board for the antenna according to an exemplary embodiment.

Supported at the back side of rack 24 is a first printed circuit board 26 and a second printed circuit board 28. According to an exemplary embodiment, first circuit board 26 includes a logic circuit, while second circuit board 28 includes a power circuit. First circuit board 26 and second circuit board 28 are supported by rack 24 in a spaced apart manner with first circuit board 26 being positioned above second circuit board 26. FIG. 23 shows first circuit board 26 according to an exemplary embodiment. First circuit board 26 is designed to have a ground plane configured to connect to an antenna (e.g., at two contact points 27, etc.). According to the embodiment illustrated, first circuit board 26 is also designed to create a matching impedance to the antenna (e.g., a matching 50 ohm impedance, etc.).

Figure 4:
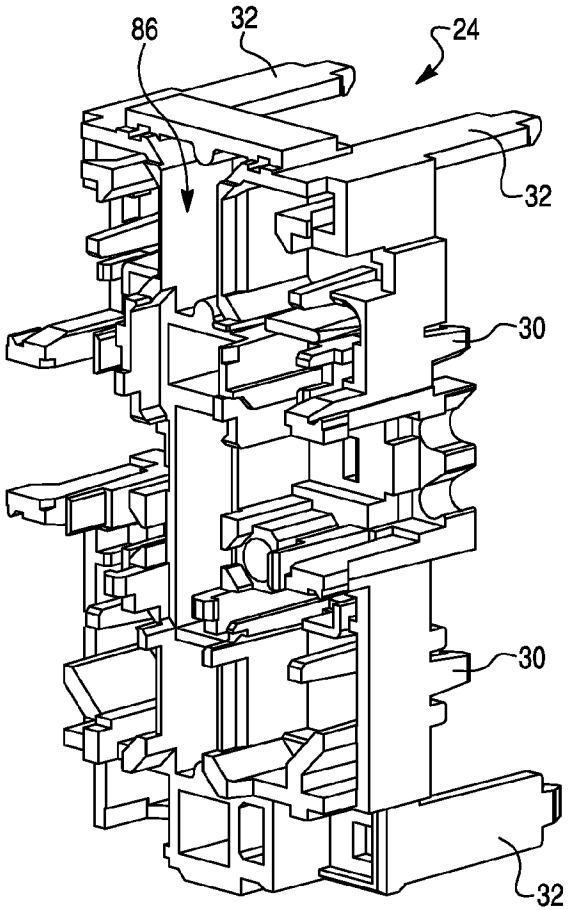
FIG. 4 is a perspective view of an embodiment of a rack of the electrical receptacle of FIG. 1.

To support first circuit board 26, rack 24 is shown as including a plurality of projections 30 (e.g., four, etc.), shown in FIG. 4, that engage first circuit board 26. To support second circuit board 28, rack 24 includes a plurality of projections 32 (e.g., four, etc.), provided at the peripheral corners of rack 24, that engage second circuit board 28. Projections 30 and 32 include barbs at their free ends that engage a back side of first circuit board 26 and second circuit board 28 respectively. Projections 30 and 32 may also include shoulder portions 34 configured to engage a front side of the circuit boards to further assist in maintaining the circuit boards at the desired position.

Figure 3:
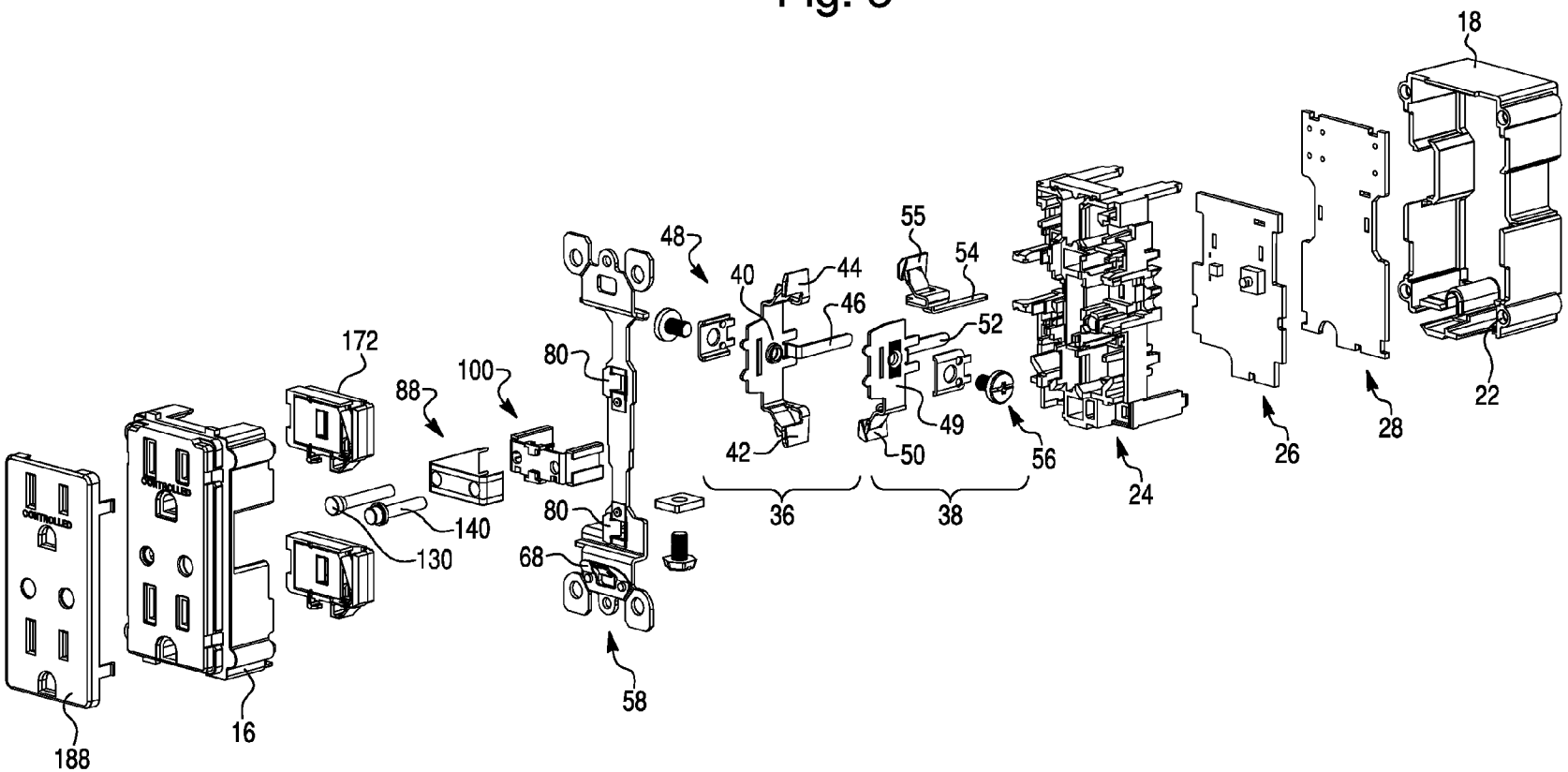
FIG. 3 is an exploded perspective view of the components of the electrical receptacle of FIG. 1.

Referring to back to FIG. 3, supported at the front side of rack 24 is a neutral current pathway structure 36 and a hot current pathway structure 38. According to the embodiment illustrated, neutral current pathway structure 36 includes a one-piece member having a neutral input terminal 40, a first neutral contact 42 for second electrical socket 14, a second neutral contact 44 for first electrical socket 12 and a neutral output lead 46 for coupling neutral current pathway 36 to second circuit board 28. Neutral current pathway structure 36 is configured to be coupled to the power source by having an electrical wire engage a screw and clamp assembly 48 that is threaded into neutral input terminal 40. According to an exemplary embodiment, neutral output lead 46 extends through an opening defined in first circuit board 26 and is soldered to second circuit board 28. To support neutral current pathway structure 36, rack 24 includes a series of projections provided along a left side of the rack that define a cavity having a shape corresponding to the shape of neutral current pathway structure 36. Neutral current pathway structure 36 is located to the interior of these projections so that the projections can electrically isolate neutral current pathway structure from the other components supported on rack 24.

According to the embodiment illustrated, hot current pathway structure 38 includes two separate structures, a first structure associated with the wirelessly controlled first socket 12 and a second structure associated with the always hot second socket 14. For example, hot current pathway structure 38 is shown as including a first structure having a hot input terminal 49, a first hot contact 50 for second electrical socket 14 and a hot output lead 52 coupled to second circuit board 28. Hot current pathway structure 38 is also shown as including a second structure having a hot input lead 54 coupled to second circuit board 28 and a second hot contact 55 for first electrical socket 12. The first structure of hot current pathway structure 38 is configured to be coupled to the power source by having an electrical wire engage a screw and clamp assembly 56 that is threaded into hot input terminal 49. The second structure of hot current pathway structure 38 is configured to be coupled to the power source by having hot input lead 54 soldered to second circuit board 28, which allows the power to first electrical socket 12 to be selectively controlled. According to an exemplary embodiment, hot output lead 52 and hot input lead 54 extend through openings defined in first circuit board 26 and are soldered to second circuit board 28. To support hot current pathway structure 38, rack 24 includes a series of projections provided along a right side of the rack that define a cavity having a shape corresponding to the shape of hot current pathway structure 38. Hot current pathway structure 38 is located to the interior of these projections so that the projections can electrically isolate hot current pathway structure from the other components supported on rack 24. These projections also electrically insolate, at least on the front side of rack 24, the first and second structures of hot current pathway structure 38. Although screw terminals are shown, these may be substituted with any suitable connection structure such as pigtails (or leads), push-in connections, modular connections and the like.

Figure 5:
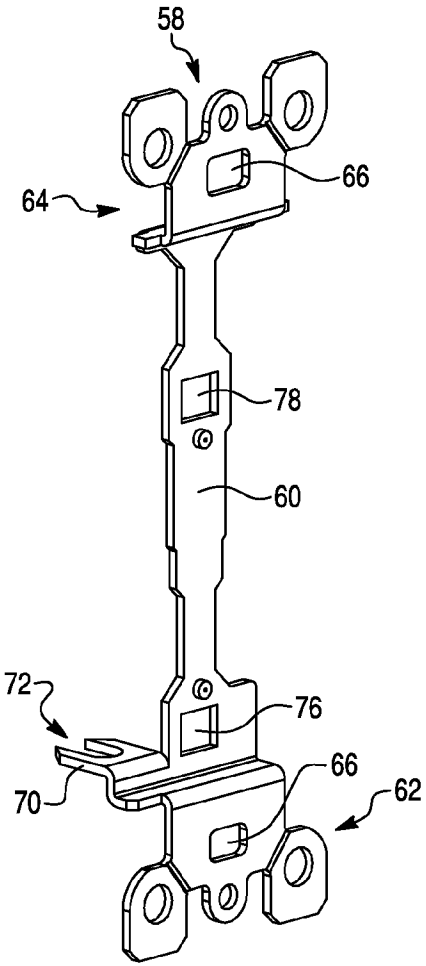
FIG. 5 is a perspective view of an embodiment of a mounting strap of the electrical receptacle of FIG. 1.
Figure 6:
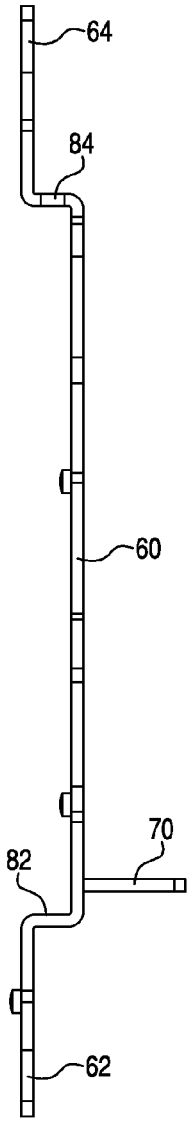
FIG. 6 is a side elevation view of the mounting strap of FIG. 5.
Figure 7:
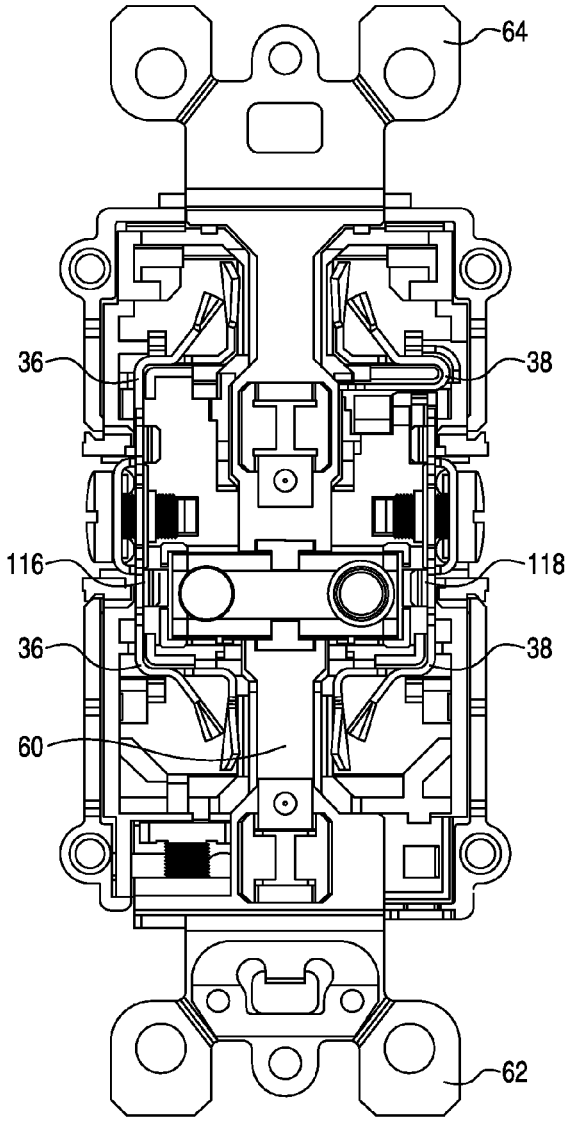
FIG. 7 is a front view of the mounting strap of FIG. 5 supported on the rack of FIG. 4.

Also supported at the front side of rack 24 is a mounting strap 58 that facilitates the mounting of electrical receptacle 10 to an electrical box (e.g., wall box, etc.). Mounting strap 58 is an elongated member that defines a longitudinal axis of electrical receptacle 10. Referring to FIGS. 5 through 7, mounting strap 58 includes an intermediate portion (e.g., central region, etc.), shown as a medial portion 60, a first mounting portion (e.g., first ear portion, etc.), shown as a first end tab portion 62, and a second mounting portion (e.g., second ear portion, etc.), shown as a second end tab portion 64. According to an exemplary embodiment, mounting strap 58 is a one-piece unitary member formed from steel sheet metal by progressive die blanking, stamping and forming procedure.

First end tab portion 62 and second end tab portion 64 extend outward from a bottom and top end of the housing of electrical receptacle 10 respectively, while medial portion 60 is substantially encased within the housing. First end tab portion 62 and second end tab portion 64 define one or more apertures 66 for receiving a mechanical fastener (e.g., screw, clip, etc.) that secures electrical receptacle 10 to the electrical box. According to an exemplary embodiment, first end tab portion 62 includes a grounding clip, shown as a self-grounding clip 68 in FIG. 3, that is configured to establish an effective grounding connection between electrical receptacle 10 and the electrical box. Self-grounding clip 68 is shown as being a substantially rectangular member having a first portion that is substantially flush with first end tab portion 62 and a second portion that is angled outwardly relative to the first portion and first end tab portion 62. Self-grounding clip 68 is coupled to first end tab portion 68 and secured thereon by one or more mechanical fasteners (e.g., screws, rivets, etc.) passing through the first portion of self-grounding clip 68. Self-grounding clip 68 defines a central aperture that is configured to be substantially aligned with aperture 66 defined by first end tab portion 62. Although mounting strap 58 is depicted as being substantially encased within the housing, the mounting strap may be constructed in any suitable manner such as wrapping around at least a portion of the exterior of the housing.

To further facilitate an effective grounded connection between electrical receptacle 10 and the electrical box, a ground contact terminal 70 is provided on mounting strap 58. According to an exemplary embodiment, ground contact terminal 70 (shown in FIG. 5) is provided near first end tab portion 62 and to the left of medial portion 60. Ground contact terminal 70 extends downward from medial portion 60 in a direction that is substantially perpendicular to medial portion 60 and first end tab portion 62. Ground contact terminal 70 defines a substantially U-shaped aperture 72 that is open towards a back side of electrical receptacle 10 for receiving screw and clamp assembly 74 that are in turn configured to secure a ground wire to mounting strap 58 in appropriate installations. In addition to securing a ground wire to mounting strap 58, screw and clamp assembly 74 also assist in securing mounting strap 58 to rack 24 because the screw is configured to terminate in a threaded opening in rack 24. As such, a positive interlock is provided between mounting strap 58 and rack 24. Alternatively, the ground connection can be implemented in any suitable fashion such as a wire lead or a modular connection.

According to an exemplary embodiment, medial portion 60 is, for the most part, relatively narrow when compared to first and second end tab portions 62 and 64. The reduced width of medial portion 60 may advantageously provide additional clearance for the antenna while still providing sufficient strength and rigidity for first and second end tab portions 62 and 64. The reduced width of medial portion 60 may also advantageously provide dielectric isolation or spacing between mounting strap 58 and a live voltage terminal. Medial portion 60 defines a pair of apertures 76 and 78 that are configured to receive the third prong of a standard plug that has been inserted into first socket 12 or second socket 14 for establishing a grounded connection. The width of medial portion 60 is increased in the areas of apertures 76 and 78 to accommodate the apertures. According to the embodiment illustrated, aperture 76 is provided at a bottom end of medial portion 60, while aperture 78 is offset from a top end of medial portion 60. According to the various alternative embodiments, the locations of the apertures may vary depending on the orientation in which a plug is configured to engage first and second sockets 12 and 14.

Referring back to FIG. 3, and according to an exemplary embodiment, grounding clips 80 are provided at apertures 76 and 78 to establish an effective grounding connection between the third prong of a plug and mounting strap 58. Grounding clips 80 are coupled to mounting strap 58 and secured thereon by one or more mechanical fasteners (e.g., screws, rivets, etc.). Grounding clips 80 defines a central aperture that is configured to be substantially aligned with apertures 76 and 78.

Figure 2:
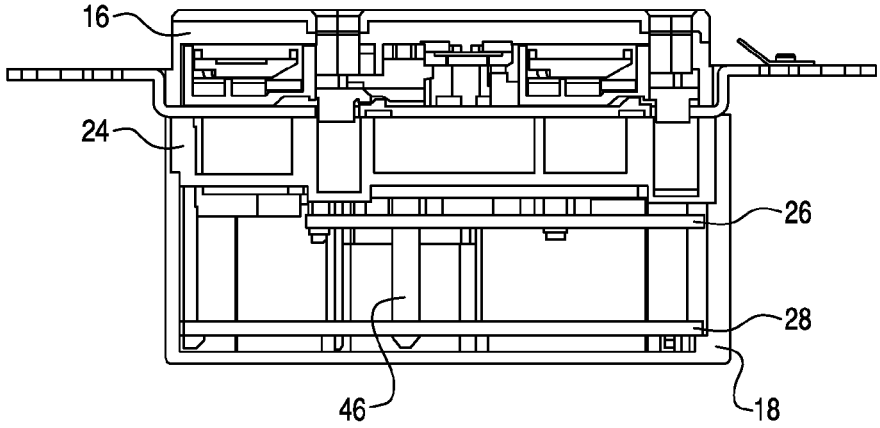
FIG. 2 is a cross sectional view of the electrical receptacle taken along a line 2-2 in FIG. 1.

Referring back to FIG. 6, and according to an exemplary embodiment, medial portion 60 is substantially parallel to first end tab portion 62 and second end tab portion 64 but is offset downwardly or inwardly relative thereto. Such a configuration enables medial portion 60 to sit lower within the housing and avoid interfering with an antenna supported at rack 24 above mounting strap 58 (as shown in FIG. 2). Such a configuration also enables medial portion 60 to rest directly on rack 24, thereby providing additional strength and rigidity to mounting strap 58. First end tab portion 62 and second end tab portion 64 are coupled to medial portion 60 by a first leg 82 and a second leg 84 respectively. According to the embodiment illustrated, first leg 82 and second leg 84 are substantially perpendicular to medial portion 60 and first and second end tab portions 62 and 64. In such an embodiment, a first 90 degree bend is provided between the end tab portions and the legs, while a second 90 degree bend is provided between the end tab portions and the medial portion. According to the various alternative embodiments, first leg 82 and second leg 84 may be provided at any angle relative to medial portion 60 and first and second end tab portions 62 and 64. According to an exemplary embodiment, first and second legs 82 and 84 are orientated just outside of an outer periphery of rack 24.

To support mounting strap 58, rack 24 includes a series of projections that define a central cavity 86 (shown in FIG. 4) extending substantially the length of rack 24 that has a shape corresponding to the shape of medial portion 60 of mounting strap 58. According to an exemplary embodiment, medial portion 60 engages the projections or walls defining central cavity 86 in a friction fit manner. Medial portion 60 sits within central cavity 86 such that the projections or walls defining central cavity 86 extend higher than a top surface of medial portion 60. Further, as shown in FIG. 7, the projections or walls defining central cavity 86 are some of the same projections that define the cavities that support neutral current pathway structure 36 and hot current pathway structure 38 and, as such, electrically isolate the neutral and hot current pathway structures from mounting strap 58.

Further supported at rack 24 is an antenna 88 configured to transmit and/or receive radio frequency (RF) signals for controlling (e.g., powering on/off, etc.) at one of first electrical socket 12 and second electrical socket 14. According to the embodiment illustrated, antenna 88 is configured to transmit and/or receive RF signals for controlling only first electrical socket 12. Antenna 88 is designed to be an improvement over other antenna designs such as a wire antenna. Specifically, antenna 88 is designed to advantageously reduce the likelihood that antenna 88 will be susceptible to interference and/or become detuned during use (e.g., when an appliance having a relatively long electrical cord is plugged into first electrical socket 12, etc.).

In the case of a wire antenna, wherein the wire antenna is routed just under the face plate of the electrical receptacle, the wire antenna will create a radioactive plane in front of the entire electrical receptacle. As a result, when a plug of an extension cord or any other cable is inserted into a socket of the receptacle, the extension cord creates interference for the antenna and detunes antenna impedance, which ultimately affects the radio performance of the antenna. Further, a wire antenna is likely to be routed along a substantial area under the face plate (including areas around or under the sockets of the electrical receptacle). As a result, when a plug is inserted into the socket, the plug will likely be covering the antenna which may also affect the radio performance of the antenna.

Figure 8:
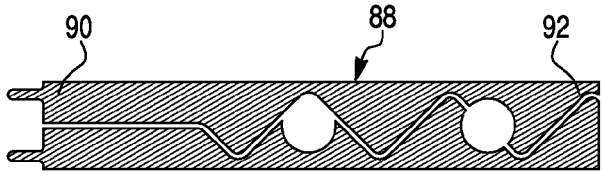
FIG. 8 is a front view of an embodiment of an antenna of the electrical receptacle of FIG. 1.

Referring to FIG. 8, an embodiment of antenna 88 is shown as being a substantially rectangular member formed of a film or sheet material. According to this exemplary embodiment, antenna 88 is formed of a foil material that is relatively flexible or malleable so that the material can be formed into the desired shape for antenna 88. More preferably the foil material is metallic and even more preferably it is formed of copper or a copper alloy. Antenna 88 includes a first end 90 configured to be coupled (e.g., soldered, etc.) to the circuit on first circuit board 26 and a second end 92 configured to remain relatively free. Antenna 88 is at least partially disposed within the housing of electrical receptacle 10. According to an exemplary embodiment, antenna 88 is entirely encased within the housing and substantially positioned between rack 24 and face portion 16.

Figure 9:
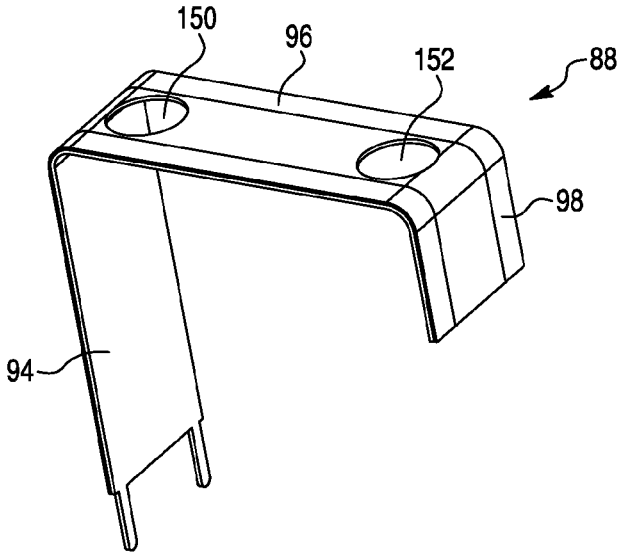
FIG. 9 is a perspective view of the antenna of FIG. 8 after being formed to fit within the electrical receptacle.

Referring to FIG. 9, antenna 88 is shown as including two leads (e.g., electrodes, etc.), shown as slots 89, that are bifurcated or offset from each other and extend along opposite peripheral edges of antenna 88. Disposed between the slots 89 is a path portion 91 (shown in FIG. 8). The length, shape and thickness will affect the tuning of antenna 88. According to the embodiment illustrated, path portion 91 is shown as being provided in a substantially zigzag pattern. Such a pattern advantageously allows the length of path portion 91 to be increased or otherwise extends without having to extend the overall length of antenna 88. According to the various alternative embodiments, path portion 91 may have any of a number of shapes and/or configurations (e.g., thickness, length, etc.). For example, the path portion may be, but not limited to a sawtooth, a sine curve, a serpentine curve, a square wave or a combination thereof.

According to the embodiment illustrated, the radio field of antenna 88 is substantially confined to the area between slots 89, unlike a wire antenna wherein the radio field would extend across an entire front area of the electrical receptacle. Thus, depending on the placement of antenna 88 within the housing, antenna 88 will be able to avoid becoming detuned when a plug of an extension cord or any other cable is inserted into electrical socket 12 or 14. According to an exemplary embodiment, antenna 88 is centrally located relative to rack 24 and is orientated substantially perpendicular to mounting strap 58 and the longitudinal axis of electrical receptacle 10. Such a position allows antenna 88 to avoid being covered by a plug inserted into electrical socket 12 or 14, and also allows the radio field created by antenna 88 to be sufficiently distanced from electrical socket 12 and 14.

Figure 10:
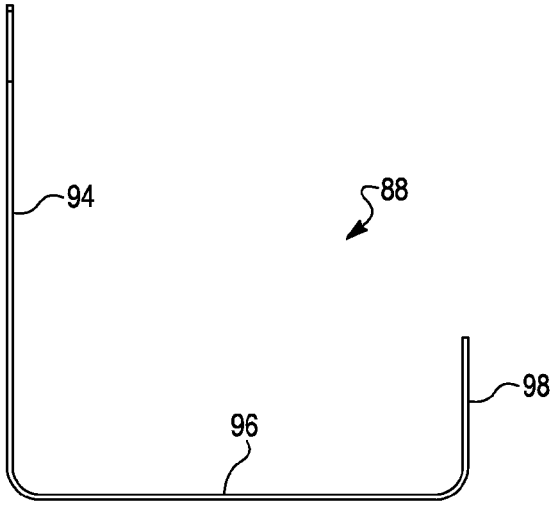
FIG. 10 is a side elevation view of the antenna of FIG. 8.

Referring to FIGS. 9 and 10, antenna 88 is shown as being formed into a substantially U-shaped member having a first portion 94, a second portion 96 and a third portion 98. First portion 94 is substantially parallel to third portion 98 and perpendicular to second portion 96. The length of third portion 98 may be varied depending on the particular application to tune the antenna to the desired impedance. To avoid possible interference from mounting strap 58, second portion 96 of antenna 88 is configured to be supported above mounting strap 58 and just behind the inside surface of cover portion 16. Supporting second portion 96 in such a position also increases the amount of dielectric isolation or spacing between antenna 88 and a live voltage terminal.

According to an exemplary embodiment, antenna 88 is designed for the reception and transmission of RF control signals at for example approximately 900 MHz frequency, and preferably 908 MHz frequency. According to the various alternative embodiments, antenna 88 may be designed for the reception and transmission of RF control signals at any of variety of frequencies, including frequencies greater than and less than the 900 MHz frequency provided above. For example, the antenna may be designed to work at any suitable frequency. This may include, but is not limited to, frequencies in the radio spectrum including, but not limited to the range of 3 Hz to 300 GHz. According to the embodiment illustrated, antenna 88 has a length of approximately two inches, a width of approximately 0.3 inches and a thickness of approximately 0.015 inches. Similar to the frequency provided above, these dimensions are provided for exemplary purposes only. According to the various alternative embodiments, antenna 88 may be designed to be any of a number of sizes, including sizes greater than and less than the sizes provided above.

Figure 11:
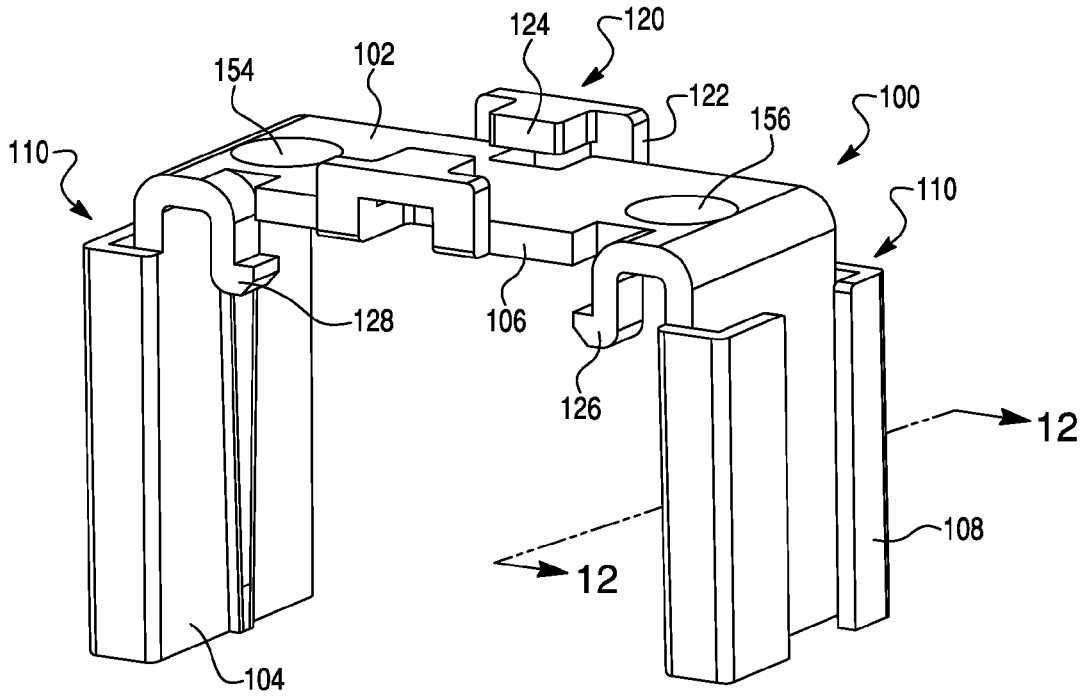
FIG. 11 is a perspective view of an embodiment of an antenna holder of the electrical receptacle of FIG. 1.
Figure 12:
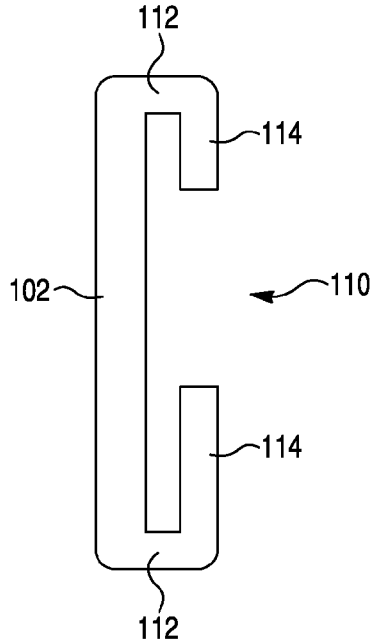
FIG. 12 is a cross sectional view of the antenna holder taken along a line 12-12 in FIG. 11.

To support antenna 88, an antenna holder 100 is provided. Antenna holder 100 is supported at the front side of rack 24 and is formed of an insulating or dielectric material, such as plastic. Referring to FIG. 11, antenna holder 100 is formed in the desired shape of antenna 88 and includes a bottom wall 102 that receives antenna 88. Since antenna 88 is preferably formed of a relatively flexible material, antenna 88 will substantially conform to the shape of antenna holder 100. According to an exemplary embodiment, bottom wall 102 has a width that is substantially equal to the width of antenna 88. According to the embodiment illustrated, antenna holder 100 has a substantially U-shaped configuration and includes a first support section 104, which corresponds to first portion 94 of antenna 88, a second support section 106, which corresponds to second portion 96 of antenna 88, and a third support section 108, which corresponds to third portion 98 of antenna 88. Alternatively, antenna holder 100 may be in the form of any suitable shape.

The shape of antenna holder 100 defines a routing passage for antenna 88 within the housing of electrical receptacle 10 that may advantageously maximize the effectiveness and/or adjustability (e.g., tuning, etc.) of antenna 88. For example, second support section 106 of antenna holder 100 positions an active portion of antenna 88 above mounting strap 58 and the other components supported on rack 24. Also, third support section 108 of antenna holder 100 may optionally have a length that is longer than third portion 98 of antenna 88. Such a configuration may advantageous allow the overall length of antenna 88 to be extended (e.g., for tuning the antenna for different applications, etc.) while still allowing antenna 88 to be supported within antenna holder 100. Further, positioning antenna holder 100 in a central portion of electrical receptacle 100 in an orientation so that antenna 88 extends substantially perpendicular to the longitudinal axis of electrical receptacle 10 may advantageously provide room within the housing for one or more tamper resistant devices as detailed below.

Figure 13:
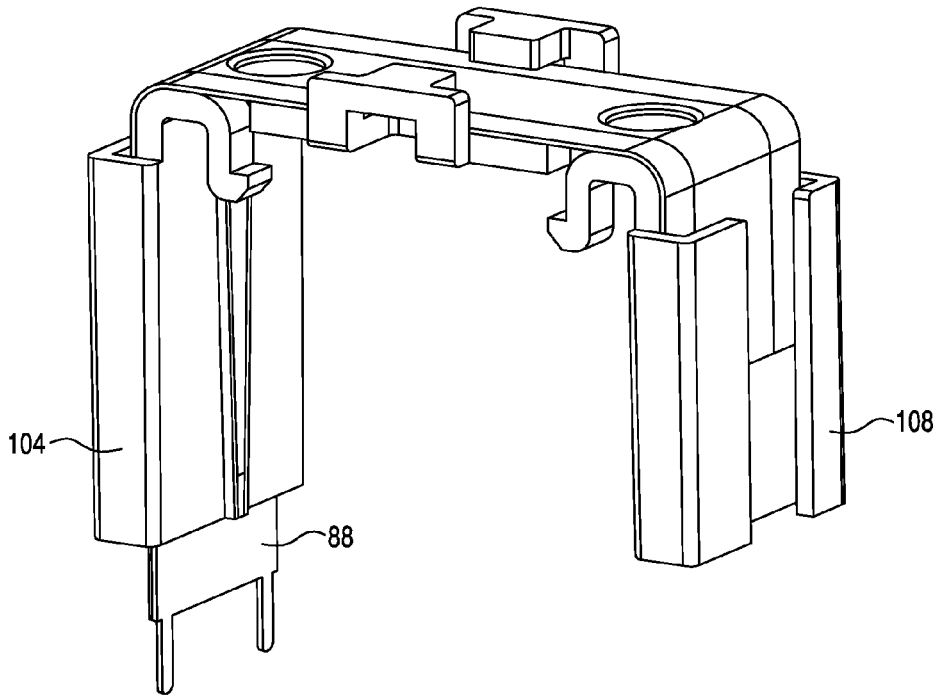
FIG. 13 is a perspective view of a subassembly of the antenna and the antenna holder.

Antenna holder 100 has locking channels 110 provided along each lateral side of first support section 104 and third support section 108 for retaining antenna 88 within antenna holder 100 and against bottom wall 102. Referring to FIG. 11, locking channels 110 include a first portion 112 that extends outward from bottom wall 102 and a second portion 114 that extends inward over bottom wall 102. FIG. 13 shows antenna 88 supported within locking channels 110. Not only do locking channels 110 retain antenna 88 within antenna holder 100, but locking channels also may advantageously isolate antenna 88 from the other components supported within the housing of electrical receptacle 10. According to the embodiment illustrated, locking channels 110 cooperate with a first projection 116 and a second projection 118 on rack 24 (shown in FIG. 7) to isolate antenna 88 from neutral current pathway structure 96 and hot current pathway structure 98 respectively. In such an embodiment, first projection 116 and second projection 118 are located between the free ends of second portions 114 of locking channels 110 and extend outward substantially the height of first support section 104 and third support section 108.

To retain section portion 96 of antenna 88 against second support section 106 of antenna holder 100, antenna holder 100 includes locking flanges 120. Referring back to FIG. 11, and according to the embodiment illustrated, locking flanges 120 are centrally located along the lateral sides of second support section 106. Similar to locking channels 110, locking flanges 120 include a first portion 122 that extends outward from bottom wall 102 and a second portion 124 that extends inward over bottom wall 102. Second portion 96 of antenna 88 is configured to be received within the area defined by the bottom wall 102 and locking flanges 120.

To secure antenna holder 100 to rack 24 such that antenna holder 100 is at least partially disposed in the housing, antenna holder 100 includes a pair of first latching elements, shown as projections 126 having barbs at their distal ends, that are configured to releasably engage a pair of second latching elements, shown as projections 128 having barbs at their distal ends, provide on rack 24. Engagement between projections 126 and projections 128 provides an interference fit that prevents antenna holder 100 from moving outward relative to rack 24.

Further supported on the front side of rack 24 is a light element, shown as a light pipe 130 in FIG. 1, that permits an internal LED or other light source to be visible to a user. Light pipe 130 may be configured to function as a status indicator such as to indicate to a user when the controlled electrical receptacle is in its on position or off position. For example, when light pipe 130 is on, the controlled receptacle (i.e., first receptacle 12) will be on, and when light pipe 130 is off, the controlled receptacle (i.e., first receptacle 12) will be off. Light pipe 130 may also be configured to illuminate an area around electrical receptacle 10 to provide guidance to a user. Light pipe 130 may also be configured to provide a visual display for a user attempting to program electrical receptacle 10. According to the various alternative embodiments, the light pipe and/or the LED may optionally be omitted.

Figure 14:
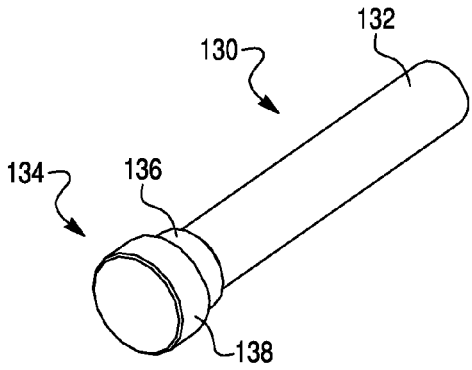
FIG. 14 is a perspective view of an embodiment of a light pipe of the electrical receptacle of FIG. 1.

Referring to FIG. 14, light pipe 130 is shown according to an exemplary embodiment. Light pipe 130 is shown as being a one-piece unitary body that is formed of a substantially transparent material. Light pipe 130 has a first end 132 supported adjacent to a light source and a second end 134 supported near the outer front surface of electrical receptacle 10. Light pipe 130 is configured to be assembled from an outer side of face portion 16 and form a friction fit therewith for retaining light pipe 130. According to an exemplary embodiment, light pipe 130 is a substantially cylindrical member having a substantially circular cross section. At second end 134, light pipe 130 includes a first annular portion 136 and a second annular portion 138. Second annular portion 138 extends radially outward from first annular portion 136 and defines a rear surface that engages a shoulder formed on face portion 16 to prevent light pipe 130 from further entering the housing when assembled. First annular portion 136 has an increased thickness intended to engage the walls defining the opening in face portion 16 to provide the friction fit and/or press-fit between light pipe 130 and face portion 16.

Further supported on the front side of rack 24 is a user interface, shown as a push button 140 in FIG. 1, that is configured to be manually actuated by a user to control a function of electrical receptacle 10. According to an exemplary embodiment, push button 140 provides a user with a manual interface for controlling the controlled electrical socket (e.g., first electrical socket, 12, etc.). For example, a user may press push button 140 inward relative to face portion 16 to turn first electrical socket 12 on or off. One or more user interfaces may also be provided to control a circuit interrupter (e.g., GFCI, AFCI, etc.) device if one is provided. For example, the user interface may control the "reset" and/or "test" function of such a GFCI device. According to the various alternative embodiments, the user interface and/or push button may optionally be omitted.

Figure 15:
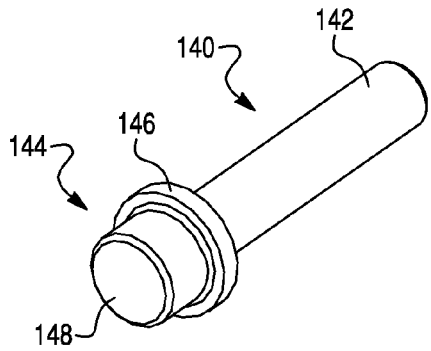
FIG. 15 is a perspective view of an embodiment of a push button of the electrical receptacle of FIG. 1.

Referring to FIG. 15, push button 140 is shown according to an exemplary embodiment. Similar to light pipe 130, push button 140 is shown as being a one-piece unitary body that is formed of a transparent material. Such an embodiment allows push button 140 to provide a visual light in addition to providing the function of a user interface. Push button 140 has a first end 142 supported adjacent to a switch coupled to first circuit board 26 and a second end 144 supported near the outer front surface of face portion 16. According to an exemplary embodiment, push button 140, unlike light pipe 130, is configured to be assembled on rack 24 before face portion 16 is assembled. Such an assembly allows push button 140 to engage an inner side of face portion 16 when face portion 16 is assembled.

According to an exemplary embodiment, push button 140 is a substantially cylindrical member having a substantially circular cross section. At second end 144, push button 140 includes a first annular portion 146 and a second annular portion 148. Second annular portion 148 defines an end surface that extends at least partially through face portion 16 and is configured to be engaged by a user. First annular portion 146 extends radially outward from second annular portion 148 and defines a front surface or shoulder that engages a shoulder formed on face portion 16 to retain push button 140 within the housing when assembled. Push button 140 is configured for axial movement relative to face portion 16 and rack 24 when pressed by a user. According to an exemplary embodiment, a biasing element (e.g., spring, etc.) is provided at first end 142 to return push button 140 to a ready position after being actuated.

Referring back to FIG. 1, light pipe 130 and push button 140 are both shown as being centrally located within electrical receptacle 10 (e.g., at the same central position as antenna 88, etc.). To allow for such a positioning of light pipe 130 and push button 140, antenna 88 and antenna holder 100 each define apertures that allow light pipe 130 and push button 140 to pass therethrough so that these components can reach first circuit board 26. For example, referring back to FIG. 9, antenna 88 is shown as including a first aperture 150 for receiving light pipe 130 and a second aperture 152 for receiving push button 140. Light pipe 130 and push button 140 are both formed of materials that will not interfere and/or create noise for antenna 88. Referring back to FIG. 11, antenna holder 100 is shown as including a first aperture 154 for receiving light pipe 130 and a second aperture 156 for receiving push button 140. These apertures are provided in second support section 106 of antenna holder 100. First apertures 150 and 154 and second apertures 152 and 156 each have a cross sectional shape (e.g., circular, etc.) that is substantially similar to the cross section of light pipe 130 and push button 140.

Figure 16:
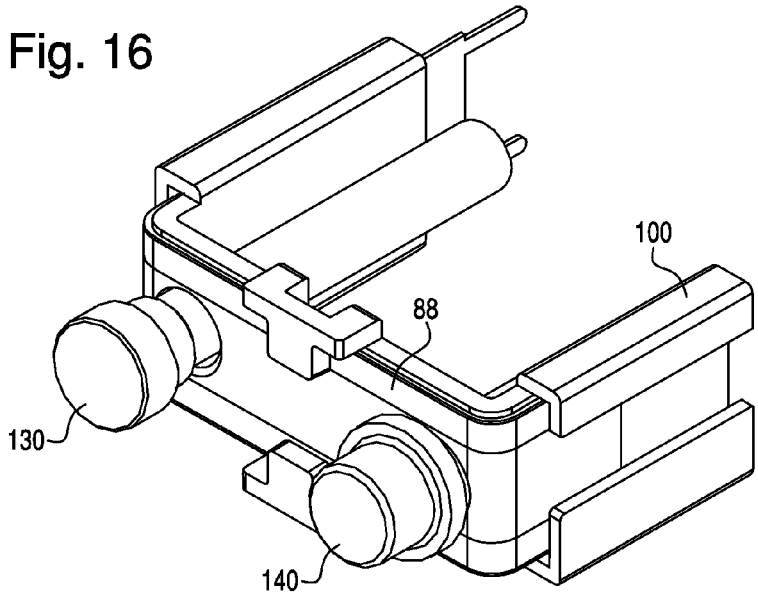
FIG. 16 is a perspective view of a subassembly of the light pipe, the push button, the antenna and the antenna holder.

An assembled view showing light pipe 130 and push button 140 engaging antenna 88 and antenna holder 100 is shown in FIG. 16. By having light pipe 130 and push button 140 extend through antenna 88 and antenna holder 100, an efficient use of the space within the housing is achieved. Also, such a configuration may provide additional support for light pipe 130 and push button 140 within the housing. For example, antenna holder 100 will function as a stabilizer for light pipe 130 and push button 140 and may prevent these components from moving in an undesired manner within the housing.

With specific reference to push button 140, a rear surface or shoulder of first annular portion 146 may engage antenna 88 and/or antenna holder 100 to prevent push button 140 from dropping further down within the housing. Further still, such a configuration may provide an additional retaining mechanism for antenna 88. For example, when light pipe 130 and push button 140 pass through antenna 88 and antenna holder 100, the movement of antenna 88 relative to antenna holder 100 is further restricted. Even further still, in addition to, or instead of, supporting light pipe 130 and push button 140, antenna 88 and antenna holder 100 may be configured to receive any other user interface or feature that may be desirably supported in a central portion of electrical receptacle 10 (e.g., a user interface for a GFCI device, etc.).

Figure 17:
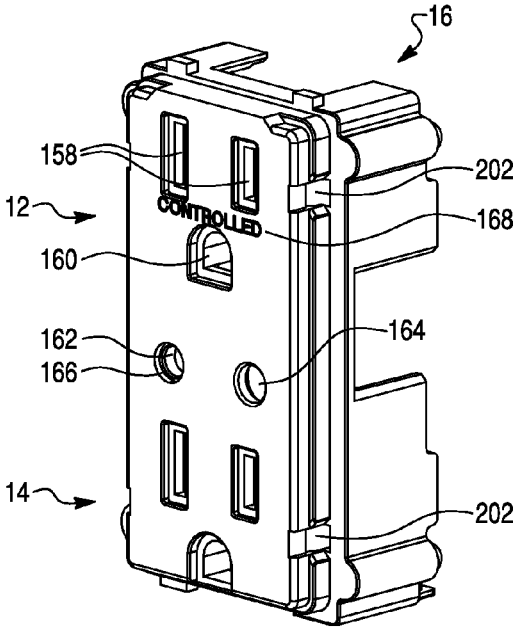
FIG. 17 is a front perspective view of an embodiment of a face portion of the electrical receptacle of FIG. 1.
Figure 18:
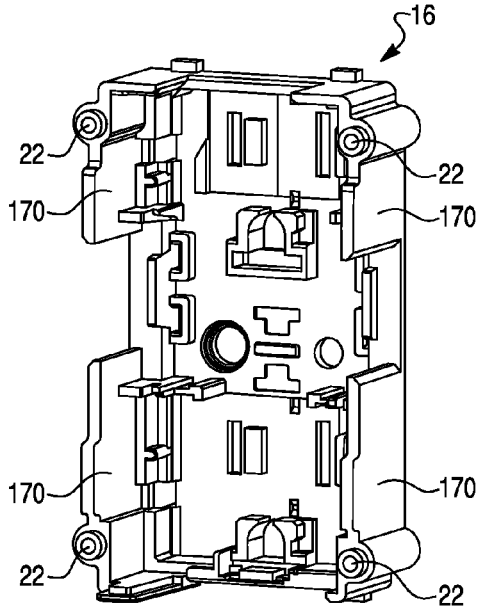
FIG. 18 is a rear perspective view of the face portion.

To at least partially enclose and conceal the components supported on the front side of rack 24, sub-face or face portion 16 is provided. Face portion 16 defines first electrical socket 12 and second electrical socket 14 by including entry ports or apertures for receiving the prongs of a male plug. Referring to FIGS. 17 and 18, face portion 16 is shown as including entry ports 158 for receiving normal or polarized prongs of a male plug, as well as ground prong receiving openings 160 to accommodate a three-wire plug. Face portion 16 is also shown as including a light receiving opening 162 to accommodate light pipe 130 and a user interface receiving opening 164 to accommodate push button 140. To prevent light pipe 130 from dropping further into the housing, face portion 16 includes an annular ledge or shoulder 166 extending around the periphery of light receiving opening 162 that is configured to engage the rear surface of second annular portion 138 of light pipe 130. Preferably the face portion 16, on which the sockets are substantially disposed, is configured such that when the interchangeable face plate or cover 188 (described below) is removed from the electrical receptacle, the interior of the housing is substantially not any more accessible than when the interchangeable face plate or cover 188 is added to the housing.

Face portion 16 is further shown as including indicia 168 between entry ports 158 and ground plug receiving opening 160 of first electrical socket 12. Indicia 168 can include numerals, letters, symbols or other markings that can be viewed from the exterior of electrical receptacle 10 and which may provide an instructional message to a user. According to the embodiment illustrated, indicia 168 comprises the term "controlled" to instruct a user as to which of the electrical sockets is wirelessly controlled. According to the various alternative embodiments, the indicia may optionally be omitted or appear in any other suitable location.

On a back side of face portion 16, face portion 16 includes four projections 170 configured to nest with and engage back portion 18. Projections 170 define an outer periphery of electrical receptacle 10 and include connection holes 22 configured to receive screws 20. On the interior of the back side, face portion 16 is configured to receive a tamper resistant device that is intended to prevent electric shock if someone attempts to insert a conductive element, other than an electrical plug, into a socket of electrical receptacle 10. According to the embodiment illustrated, face portion 16 is configured to receive a first tamper resistant device associated with first electrical socket 12 and a second tamper resistant device associated with second electrical socket 14. Face portion 16 includes projections for receiving and seating such tamper resistant devices.

Figure 19:
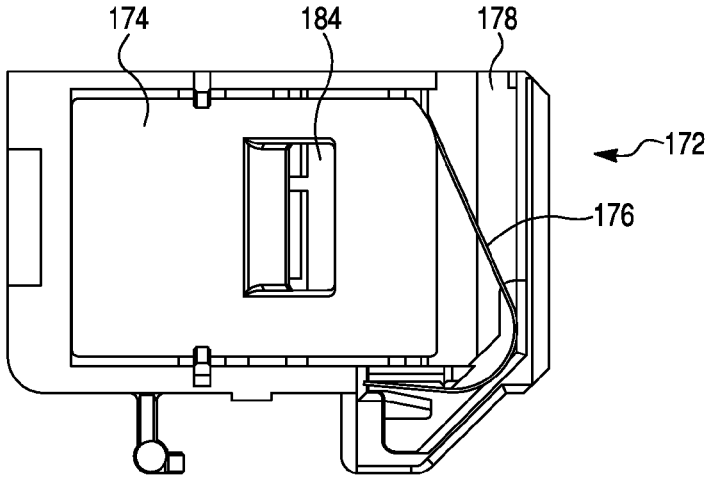
FIG. 19 is a front view of an embodiment of a tamper resistant device of the electrical receptacle of FIG. 1.

Referring to FIG. 19, a tamper resistant device 172 is shown according to an exemplary embodiment. Tamper resistant device 172 is configured to block entry ports 156 in face portion 16 (and thus the corresponding entry ports in the socket) unless a mating electrical plug is inserted into the socket. Tamper resistant device 172 is at least partially disposed in the housing of electrical receptacle 10. Tamper resistant device 172 includes a slider 174, a resilient member (e.g., biasing element, spring, etc.), shown as a leaf spring 176, and a platform 178. Platform 178 includes a pair of apertures 180 and 182 configured to be aligned with entry ports 158 in face portion 16. Slider 174 includes an aperture 184 and is moveable relative to platform 178 between a first position, in which aperture 184 is misaligned with either entry port 158 in face portion 16, and a second position, in which aperture 184 is aligned with one of entry ports 158 in face portion 16. Leaf spring 176 is configured to bias slider 174 towards the first position and includes a first end that is mounted in a pocket 186 of platform 178 and a second end that is configured to engage slider 174. Pocket 186 allows leaf spring 176 to rest in platform 178 and to hold slider 174 in place in a first position wherein the slider aperture 184 is misaligned with either aperture 180 and 182 of platform 178.

When an electrical plug having a pair of prongs is inserted into face portion 16 through entry ports 158, slider 174 initially blocks entry into the electrical socket. As the prongs of the plug are inserted further, slider 174 slides into a second position such that aperture 184 comes into alignment with one of apertures 180 and 182. Once slider 174 transitions completely to the second position, slider 174 aligns with entry ports 158 to allow a first prong of the plug to bypass on a side of slider 174 and a second prong the plug to pass through aperture 184. As such, the width of slider 174 is designed such that the other prong gains clearance straight through to the receptacle contact when aperture 184 aligns with one of entry ports 158. In this position, slider 174 presses against leaf spring 176 and is held in the alignment position by the prongs of the plug which are inserted therein. When the prongs are removed, the biasing force of leaf spring 176 urges slider 174 back into the misaligned position.

In the case where an object is inserted into only one of entry ports 158, slider 174 remains confined in the misaligned position or the first position. For example, when an object is inserted into only one of entry ports 158, slider 174 is pushed down towards platform 178 and is confined by a lower rib or projection 186. Thus, even if a determined attempt is made to force the object into only one of entry ports 158, projection 186 blocks slider 174 from movement out of the first position where aperture 184 is misaligned with entry ports 158. The object is thereby prohibited from making contact with a contact of the electrical socket.

Figure 20:
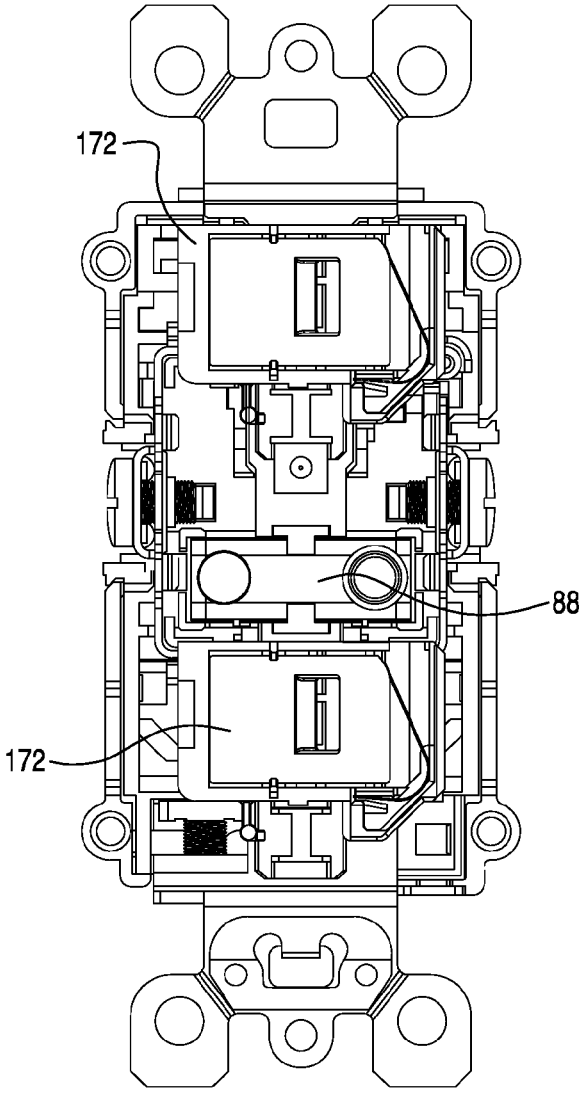
FIG. 20 is a front view of the electrical receptacle of FIG. 1, without the face portion.

FIG. 20 shows electrical receptacle 10 without face portion 16. It is clear from this illustration that the inclusion of tamper resistant devices 172 is only possible because of the configuration of antenna 88 and antenna holder 100. According to the embodiment illustrated, tamper resistant devices 172 extend laterally across electrical receptacle 10 and cover a substantially portion of rack 24 near first electrical socket 12 and second electrical socket 14. The configuration of antenna 88 and antenna holder 100 advantageously allow for the positioning of tamper resistant devices 172 in such a manner.

Figure 21:
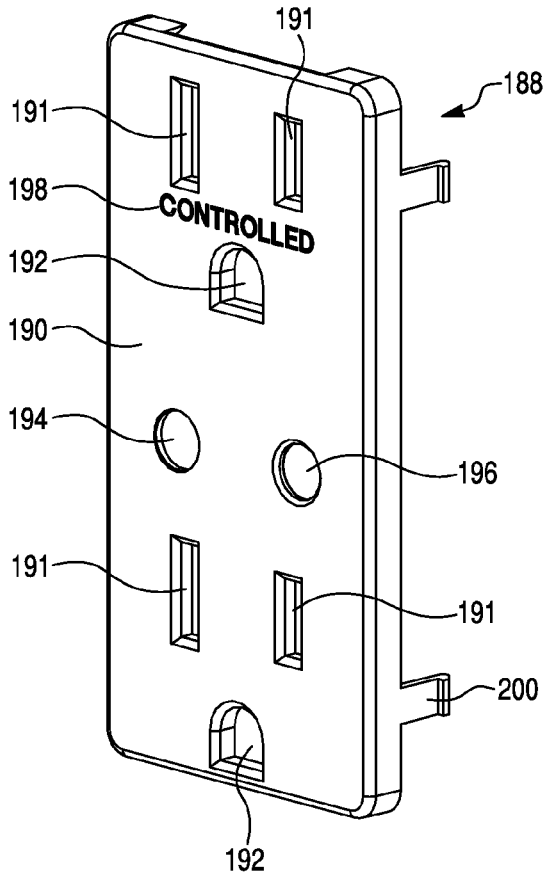
FIG. 21 is a perspective view of an embodiment of a removable face cover separate from the electrical receptacle of FIG. 1.
Figure 22:
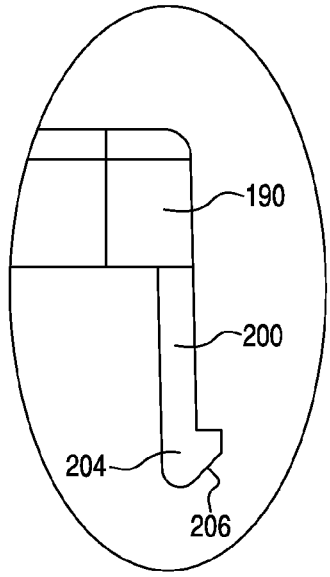
FIG. 22 is a partial detailed end view of a portion of the removable face cover.

Referring to FIGS. 21 and 22, electrical receptacle 10 may also include a feature that allows for an interchangeable face portion. Such a feature may advantageously allow the color and/or style of face portion to be changed without having to replace the entire electrical receptacle. According to an exemplary embodiment, electrical receptacle 10 includes a face plate or cover 188 that can be selectively added to and/or removed from electrical receptacle 10 by a user with minimal effort. The addition and/or removal of face cover 188 is entirely independent of the components of electrical receptacle so that face cover 188 can be added to and/or removed from electrical receptacle 10 without disassembling electrical receptacle 10 and/or without having to remove electrical receptacle 10 from its installed position.

Face cover 188 includes a substantially planar portion 190 that is substantially similar in appearance to the front surface of cover portion 16. According to the embodiment illustrated, face cover 188 includes entry ports 191 for aligning with entry ports 158 and receiving normal or polarized prongs of a male plug, as well as ground prong receiving openings 192 for aligning with ground receiving openings 160 and to accommodate a three-wire plug. Face cover 188 is also shown as including a light receiving opening 194 for aligning with light receiving opening 162 and accommodating light pipe 130 and a user interface receiving opening 196 for aligning with user interface receiving opening 164 and accommodating push button 140. Light receiving opening 194 and user interface receiving opening 196 are advantageously sized so that face cover 188 can be added to and removed from electrical receptacle 10 without having to remove light pipe 130 or push button 140. Face cover 188 is further shown as including indicia 198 between entry ports 190 and ground plug receiving opening 192 associated with first electrical socket 12. As illustrated, indicia 190 comprises the term "controlled" to instruct a user as to which of the electrical sockets is wirelessly controlled.

To allow for the selective coupling of face cover 188 to electrical receptacle 10, face cover 188 includes one or more projections, shown as connection posts 200, the extend outward from a back side of portion 190. According to the embodiment illustrated, face cover 188 includes four connection posts 200 that are spaced apart around a peripheral edge of portion 190 near the corners. Connection posts 200 are configured to be received by connection openings 202 defined by face portion 16 (shown in FIG. 17). The distal ends of connection posts 200 includes a lip or barb 204 that is configured to engage face portion 16 as connection posts 200 are inserted into connection openings 202. An outer surface of barb 204 is angled in a curved and/or linear manner and functions as a camming surface 206 as connection posts 200 are inserted into connection openings 200. The engagement of camming surfaces 206 with face portion 16 initially flexes connection posts 200 inward. Once camming surfaces 206 pass a wall of face portion 16, connection posts 200 flex back outward and the underside surfaces of barbs 204 engage an underside surface of face portion 16 to secure face cover 188 to face portion 16. To remove face cover 188, a user can simply apply a sufficient outward force to face cover 188 to overcome the retention force between barbs 204 and face portion 16.

It is important to note that the terms used herein are intended to be broad terms and not terms of limitation. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. Such joining may relate to a mechanical and/or electrical relationship between the two components.

It is also important to note that the construction and arrangement of the elements of the electrical receptacle as shown in the exemplary embodiments are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. Accordingly, all such modifications are intended to be included within the scope of the appended claims.

The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention as expressed in the appended claims.

What is claimed is:

1. An electrical receptacle comprising:

a housing;

at least one socket at least partially disposed within the housing and having at least a pair of entry ports, the at least one socket being controllable by a radio frequency signal;

an antenna at least partially disposed within the housing configured to at least receive the radio frequency signal used to control the at least one socket; and at least one tamper resistant device at least partially disposed within the housing, the at least one tamper resistant device configured to block the entry ports unless a mating electrical plug is inserted into the at least one socket.

2. The electrical receptacle of claim 1, wherein the at least one tamper resistant device comprises a base, a slider movably supported by the base and a resilient member that urges the slider to a position that blocks the entry ports.

3. The electrical receptacle of claim 1, wherein the at least one socket comprises a first socket that is controllable by the radio frequency signal and a second socket that is configured to always be coupled to a source of electrical power.

4. The electrical receptacle of claim 1, wherein the antenna is formed of a foil material.

5. The electrical receptacle of claim 1, further comprising an interchangeable face cover configured to be selectively added to or removed from the housing independently of the components of the electrical receptacle.

6. The electrical receptacle of claim 5, wherein the housing further comprises a sub-face on which the at least one socket is substantially disposed, such that when the interchangeable face cover is removed from the electrical receptacle, the interior of the housing is substantially not any more accessible than when the interchangeable face cover is added to the housing.

7. The electrical receptacle of claim 1, further comprising a mounting strap extending in a longitudinal direction of the electrical receptacle, wherein the mounting strap includes a pair of end portions ending outside of the housing and a central portion supported within the housing, the central portion being inwardly offset from the end portions.

8. The electrical receptacle of claim 1, further comprising a mounting strap extending in a longitudinal direction of the electrical receptacle and an antenna holder supported at least partially within the housing and electrically isolating the antenna, the antenna holder having a support surface extending over the mounting strap in a direction that is substantially perpendicular to the longitudinal axis of the electrical receptacle.

9. The electrical receptacle of claim 8, further comprising a light pipe and a user interface supported at least partially within the housing, and wherein the antenna and the antenna holder each include apertures allowing the light pipe and the user interface to pass through the antenna and antenna holder.

10. The electrical receptacle of claim 9, wherein the user interface includes a push button that allows a user to manually control the at least one socket.

11. An electrical receptacle comprising:

a housing;

at least one electrical socket being controllable by a radio frequency signal;

at least one printed circuit board at least partially disposed within the housing;

a circuit at least partially supported by the printed circuit board, the circuit being configured to control the at least one electrical socket; and an antenna supported at least partially within the housing configured to at least receive the radio frequency signal used to control the at least one electrical socket, the antenna being formed of a sheet material and having a first end and a second end, the first end being coupled to the circuit.

12. The electrical receptacle of claim 11, wherein the sheet material includes a foil material.

13. The electrical receptacle of claim 11, further comprising an antenna holder at least partially disposed within the housing, the antenna holder being configured and positioned to electrically isolate the antenna from a current pathway within the housing.

14. The electrical receptacle of claim 13, wherein the antenna holder includes first support portion extending in a first plane, a second support portion extending in a second plane and a third support portion extending in a third plane, the first plane and the third plane being substantially parallel to each other and perpendicular to the second plane which is substantially parallel to a front surface of the housing.

15. The electrical receptacle of claim 14, wherein second end of the antenna is supported by the third support portion, and wherein the third support portion extends beyond the second end so that the antenna can be tuned by adjusting a length of the antenna while still allowing for the antenna to be supported by the antenna holder.

* * * * *